US009262969B2

(12) United States Patent
Huang

(10) Patent No.: US 9,262,969 B2
(45) Date of Patent: Feb. 16, 2016

(54) ELECTRONIC DEVICE AND METHOD FOR BACKLIGHTING LCD DISPLAY TO PROVIDE DIFFERENT DISPLAY DEFINITIONS

(71) Applicants: HONG FU JIN PRECISION INDUSTRY (WuHan) CO., LTD., Wuhan (CN); HON HAI PRECISION INDUSTRY CO., LTD., New Taipei (TW)

(72) Inventor: Hung-Chi Huang, New Taipei (TW)

(73) Assignees: HONG FU JIN PRECISION INDUSTRY (WuHan) CO., LTD., Wuhan (CN); HON HAI PRECISION INDUSTRY CO., LTD., New Taipei (TW)

( * ) Notice: Subject to any disclaimer, the term of this patent is extended or adjusted under 35 U.S.C. 154(b) by 163 days.

(21) Appl. No.: 14/177,235

(22) Filed: Feb. 11, 2014

(65) Prior Publication Data

US 2014/0292829 A1 Oct. 2, 2014

(30) Foreign Application Priority Data

Mar. 29, 2013 (TW) ..... 102111337 A

(51) Int. Cl.
*G09G 3/36* (2006.01)
*G09G 3/34* (2006.01)

(52) U.S. Cl.
CPC ..... *G09G 3/3406* (2013.01); *G09G 2340/0407* (2013.01); *G09G 2340/0442* (2013.01)

(58) Field of Classification Search
CPC ..... G06K 9/32; G09G 3/30; G09G 3/32; G09G 3/36; G09G 3/38; G09G 5/00; H04N 21/2385; H04N 21/2662; H04N 21/234381; G06F 3/038
USPC ..... 345/102
See application file for complete search history.

(56) References Cited

U.S. PATENT DOCUMENTS

| | | | | |
|---|---|---|---|---|
| 8,749,470 | B2 * | 6/2014 | Furihata | G09G 3/3406 345/102 |
| 2009/0262064 | A1 * | 10/2009 | Li | G09G 3/342 345/102 |
| 2011/0037784 | A1 * | 2/2011 | Shiomi | G09G 3/3426 345/690 |
| 2011/0193895 | A1 * | 8/2011 | Johnson | G09G 3/3426 345/690 |
| 2013/0016036 | A1 * | 1/2013 | Chang | G09G 3/3426 345/102 |
| 2013/0265311 | A1 * | 10/2013 | Na | G06T 3/40 345/428 |

* cited by examiner

*Primary Examiner* — Pegeman Karimi
(74) *Attorney, Agent, or Firm* — Novak Druce Connolly Bove + Quigg LLP

(57) ABSTRACT

Electronic device and a method for backlighting a liquid crystal display (LCD) display to provide different display definitions, the LCD display includes a backlight unit composed of one or more backlighting blocks. The method determines a display definition of a video image and illuminates or turns off backlighting blocks of the backlight unit to display the video image accordingly. The video image is displayed in full screen by all backlighting blocks if the video image is an ultra high definition (UHD) image, and turns on a smaller number of the backlighting blocks to display the video image if the video image has other than UHD display definition. As such, the electronic device is controlled to save power consumption in different display definitions of the LCD display.

18 Claims, 8 Drawing Sheets

ELECTRONIC DEVICE AND METHOD FOR BACKLIGHTING LCD DISPLAY TO PROVIDE DIFFERENT DISPLAY DEFINITIONS

BACKGROUND

1. Technical Field

Embodiments of the present disclosure relate to display systems and methods, and particularly to an electronic device and a method for backlighting a liquid crystal display (LCD) display to provide different display definitions.

2. Description of Related Art

A light emitting diode (LED) panel can be used to backlight a liquid crystal display (LCD) screen. The LCD screen displays images, and the LED panel includes an LED array for providing a light source to backlight the LCD screen. Since the luminance of the backlighting depends on the current that flows in the LED panel, it is difficult to control the duty cycle of on time and off time of the current that flows in the LED panel. To display a ultra high definition image on the LCD screen, all LEDs of the LED panel must be turned on and increase power consumption. Therefore, there is room for improvement within the art.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

The present disclosure, including the accompanying drawings, is illustrated by way of examples and not by way of limitation. It should be noted that references to "an" or "one" embodiment in this disclosure are not necessarily to the same embodiment, and such references mean "at least one."

In the present disclosure, the word "module," as used herein, refers to logic embodied in hardware or firmware, or to a collection of software instructions, written in a program language. In one embodiment, the program language may be Java, C, or assembly. One or more software instructions in the modules can be embedded in firmware, such as in an EPROM. The modules described herein can be implemented as either software and/or hardware modules and can be stored in any type of non-transitory computer-readable media or storage medium. Some non-limiting examples of a non-transitory computer-readable medium comprise CDs, DVDs, flash memory, and hard disk drives.

Figure 1:
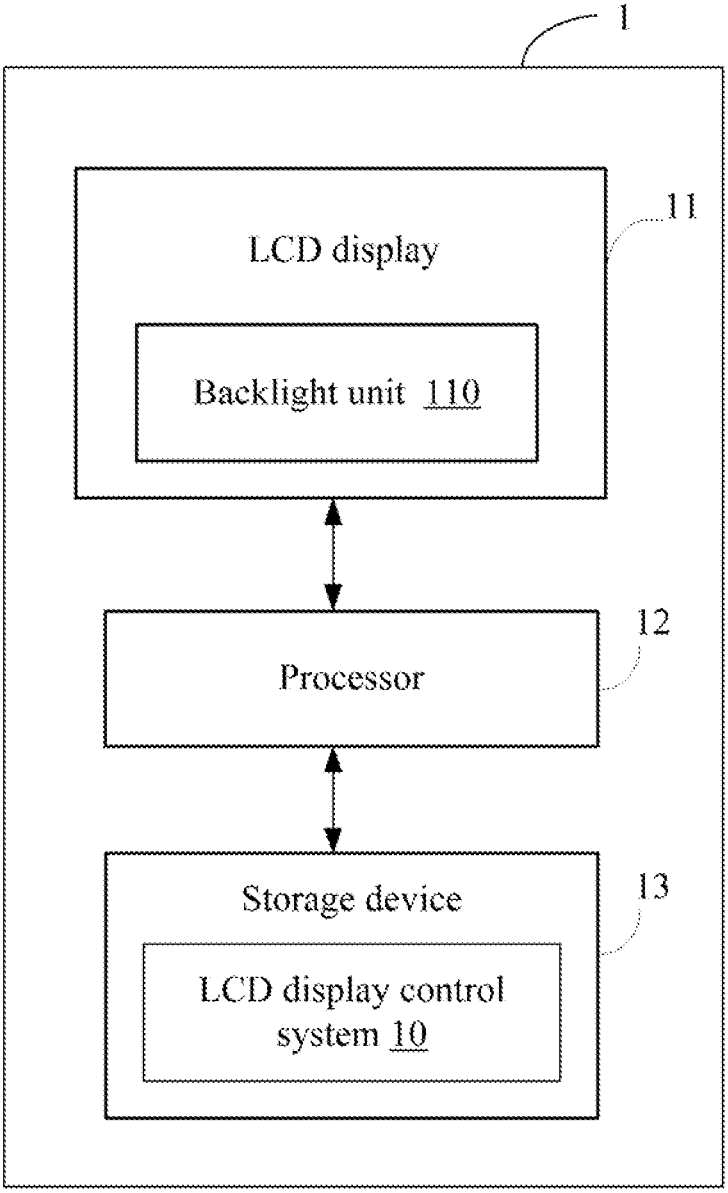
FIG. 1 is a block diagram of one embodiment of an electronic device comprising an LCD display control system.

FIG. 1 is a block diagram of one embodiment of an electronic device 1 comprising a liquid crystal display (LCD) display control system 10. In the embodiment, the electronic device 1 further includes, but is not limited to, an LCD display 11, at least one processor 12, and a storage device 13. The LCD display 11 is a high definition display including a backlight unit 110. The backlight unit 110 includes a light emitting diode (LED) array composed of a plurality of LEDs for providing a light source to backlight the LCD display 11. In the embodiment, the LCD display control system 10 comprises computerized instructions in the form of one or more computer-readable programs stored in the storage device 13 and executed by the at least one processor 12. The electronic device 1 can be a television, a notebook computer, a mobile device, a personal digital assistant (PDA) device, or the like. FIG. 1 is only one example of the electronic device 1, other examples may comprise more or fewer components than those shown in the embodiment, or have a different configuration of the various components.

The LCD display 11 can display video images having different levels of definition, such as a full high definition (FHD), denoted as 1920×1080, a quadruple high definition (QHD), denoted as 2840×2160, or an ultra high definition (UHD), denoted as 7680×4320. The at least one processor 12 can be a central processing unit (CPU), a microprocessor, or other data processor chip that performs various functions of the electronic device 1. In one embodiment, the storage device 13 can be an internal storage system, such as a flash memory, a random access memory (RAM) for temporary storage of information, and/or a read-only memory (ROM) for permanent storage of information. The storage device 13 can also be an external storage system, such as an external hard disk, a storage card, or a data storage medium.

Figure 7:
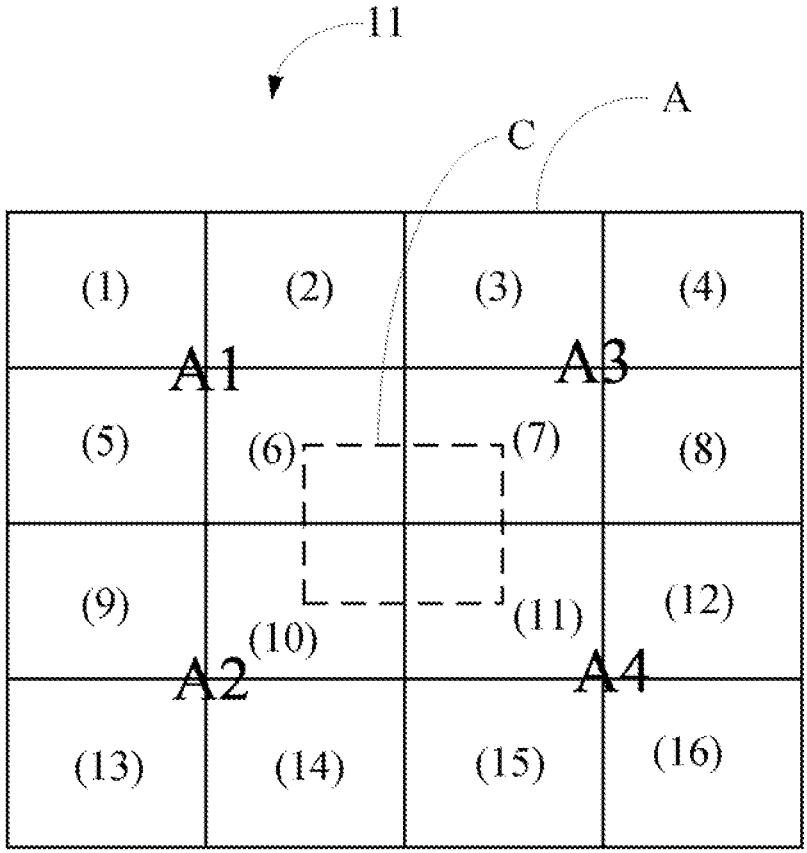
FIG. 7 is a schematic diagram illustrating one embodiment of backlighting blocks included in a backlight unit of the LCD display.

In the embodiment, the LCD display 11 can be logically divided into a plurality of display areas, such as a center display area C and display areas A1, A2, A3, and A4, as shown in FIG. 7. The backlight unit 110 can be logically divided into a plurality of backlighting blocks, such as block (1) to block (16), also shown in FIG. 7. Each of the backlighting blocks includes one or more LEDs for providing a light source to backlight a display area of the LCD display 11. For example, if the video image needs to be displayed on the center area (C in FIG. 7) of the LCD display 11, the LEDs of the backlighting blocks corresponding to the center area (C in FIG. 7) are powered on to provide light source for backlighting the center area, and the LEDs of other backlighting blocks are powered off to decrease power consumption.

Figure 2:
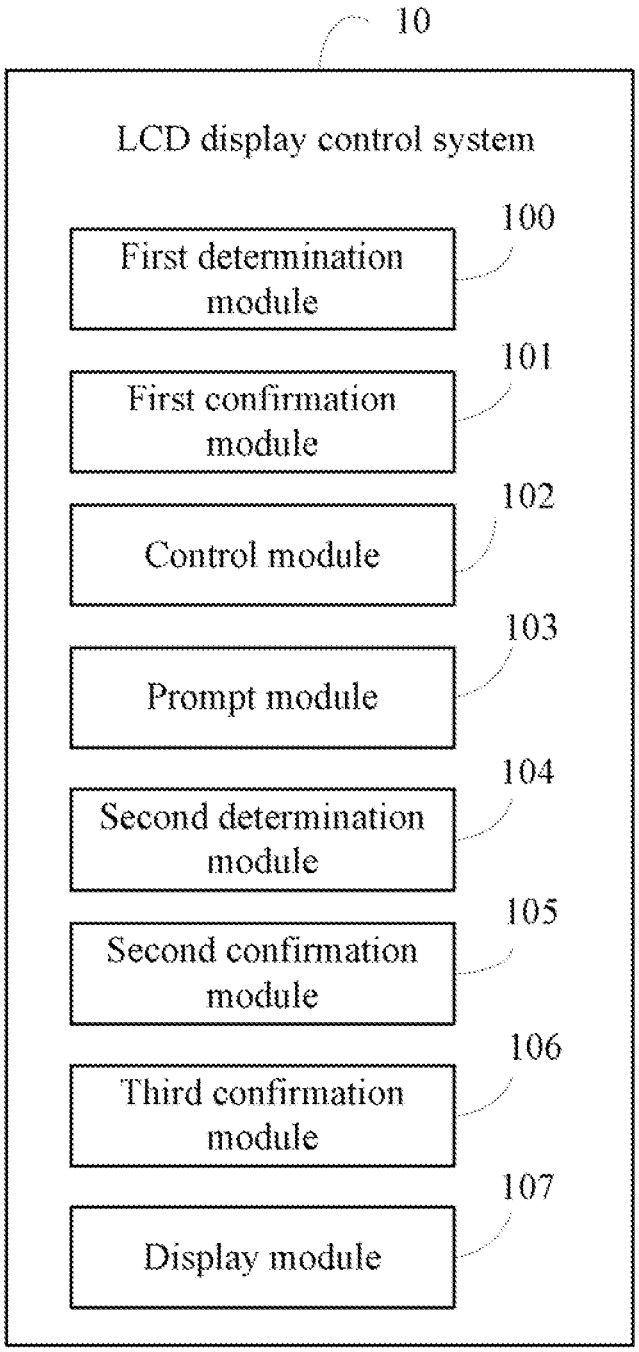
FIG. 2 is a block diagram illustrating function modules of the LCD display control system in FIG. 1.

FIG. 2 is a block diagram illustrating function modules of the LCD display control system 10. In one embodiment, the LCD display control system 10 can comprise a first determination module 100, a first confirmation module 101, a control module 102, a prompt module 103, a second determination module 104, a second confirmation module 105, a third confirmation module 106, and a display module 107. The modules 100-107 can comprise computerized instructions in the form of one or more computer-readable programs that are stored in a non-transitory computer-readable medium (such as the storage device 13) and executed by the at least one processor 12 of the electronic device 1. A description of each module follows.

Figure 3:
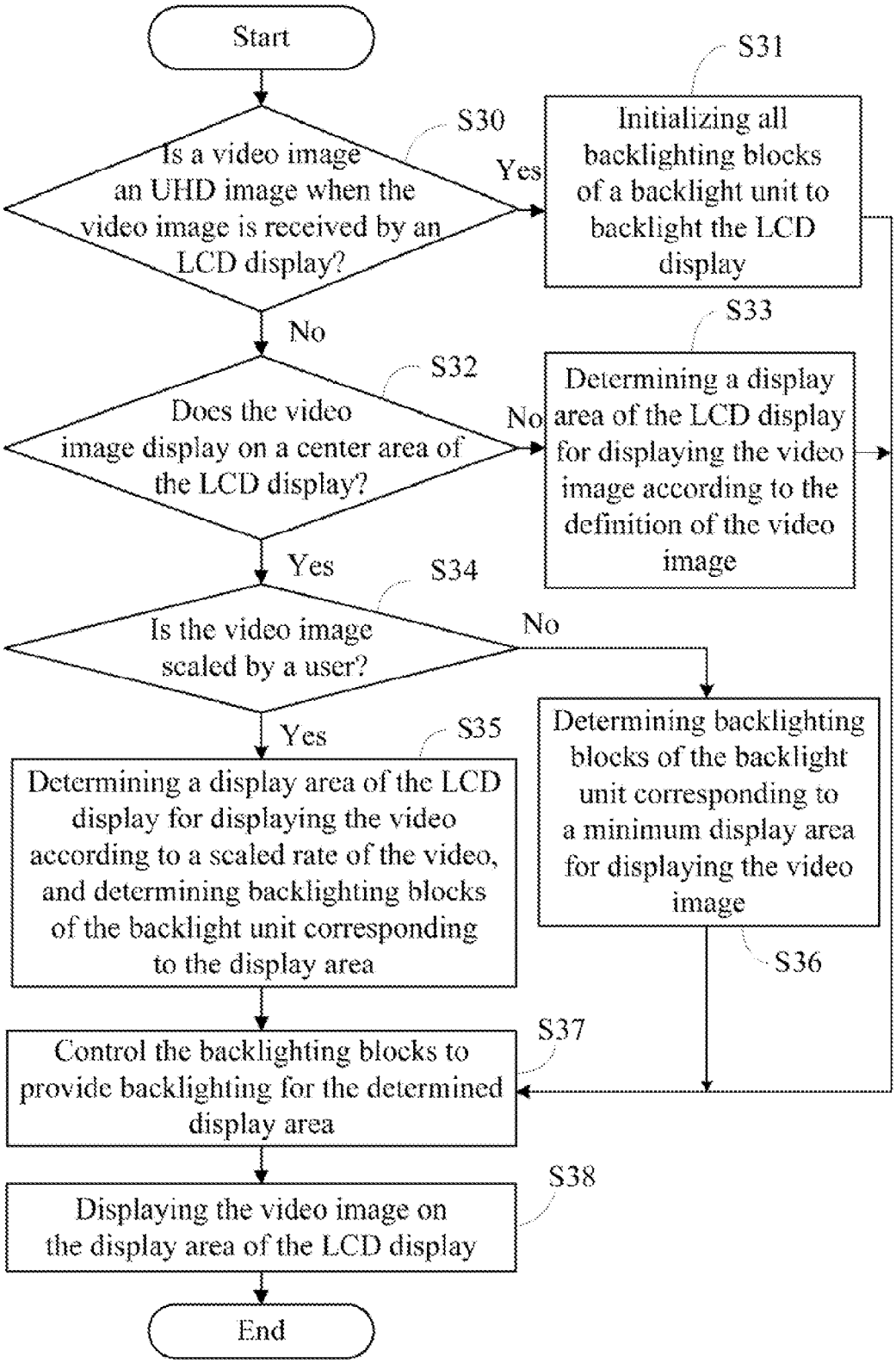
FIG. 3 is a flowchart of one embodiment of a method for backlighting an LCD display to provide different display definitions.

FIG. 3 is a flowchart of one embodiment of a method for backlighting an LCD display to provide different display definitions. In one embodiment, the method is performed by execution of computer-readable software program codes or instructions by the at least one processor 12 of the electronic device 1. By implementing the method, the electronic device 1 is automatically controlled to reduce power consumption in different display definitions of the LCD display. Depending on the embodiment, additional steps can be added, other steps can be removed, and the ordering of the steps can be changed.

In step S30, when a video image is received by the LCD display 11, the first determination module 100 determines whether the video image is an ultra high definition (UHD) image. In the embodiment, if the definition of the video image is 7680×4320, the first determination module 100 determines that the video image is a UHD image, and step S31 is implemented. If the video image is not a UHD image, step S32 is implemented.

In step S31, the first confirmation module 101 confirms that the UHD image is displayed on the LCD display 11 in full screen, and initializes all backlighting blocks of the backlight unit 110 to backlight the LCD display 11. In the embodiment, if the LCD display 11 displays the UHD image in a full screen, all LEDs of the backlight unit 110 are powered on to provide a light source for the LCD display 11.

In step S32, the prompt module 103 determines whether the video image needs to be displayed on a center area of the LCD display 11 according to a position display parameter. In one embodiment, the prompt module 103 displays a check box on the LCD display 11 for a user to set the position display parameter. When the user selects the check box requiring the video image to be displayed on a center area of the LCD display 11, the video image is displayed on the center area of the LCD display 11, and step S34 is implemented. Otherwise, if the video image is not required to be displayed on the center area of the LCD display 11, step S33 is implemented.

Figure 4:
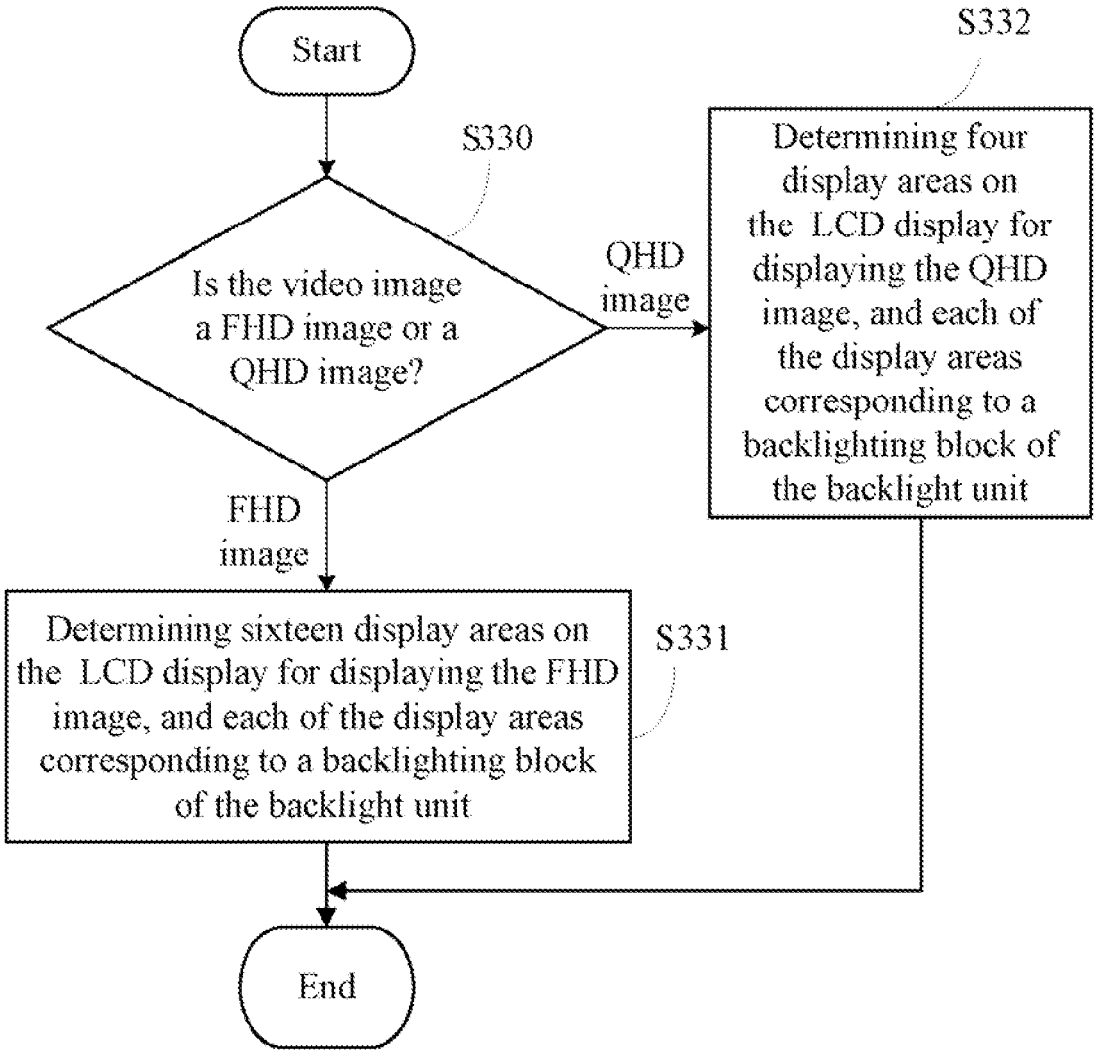
FIG. 4 is a detailed flowchart of step S33 in FIG. 3.

In step S33, the second determination module 104 determines a display area of the LCD display 11 for displaying the video image according to the definition of the video image, and then step S36 is implemented. A detailed description of step S33 is illustrated in FIG. 4.

In step S34, the second determination module 104 determines whether the video image is scaled by the user. In the embodiment, the user can zoom in to the video image or zoom out of the video image when the video image is displayed on the LCD display 11. If the video image is scaled by the user, step S35 is implemented. If the video image is not scaled by the user, step S33 is implemented as described above.

Figure 5:
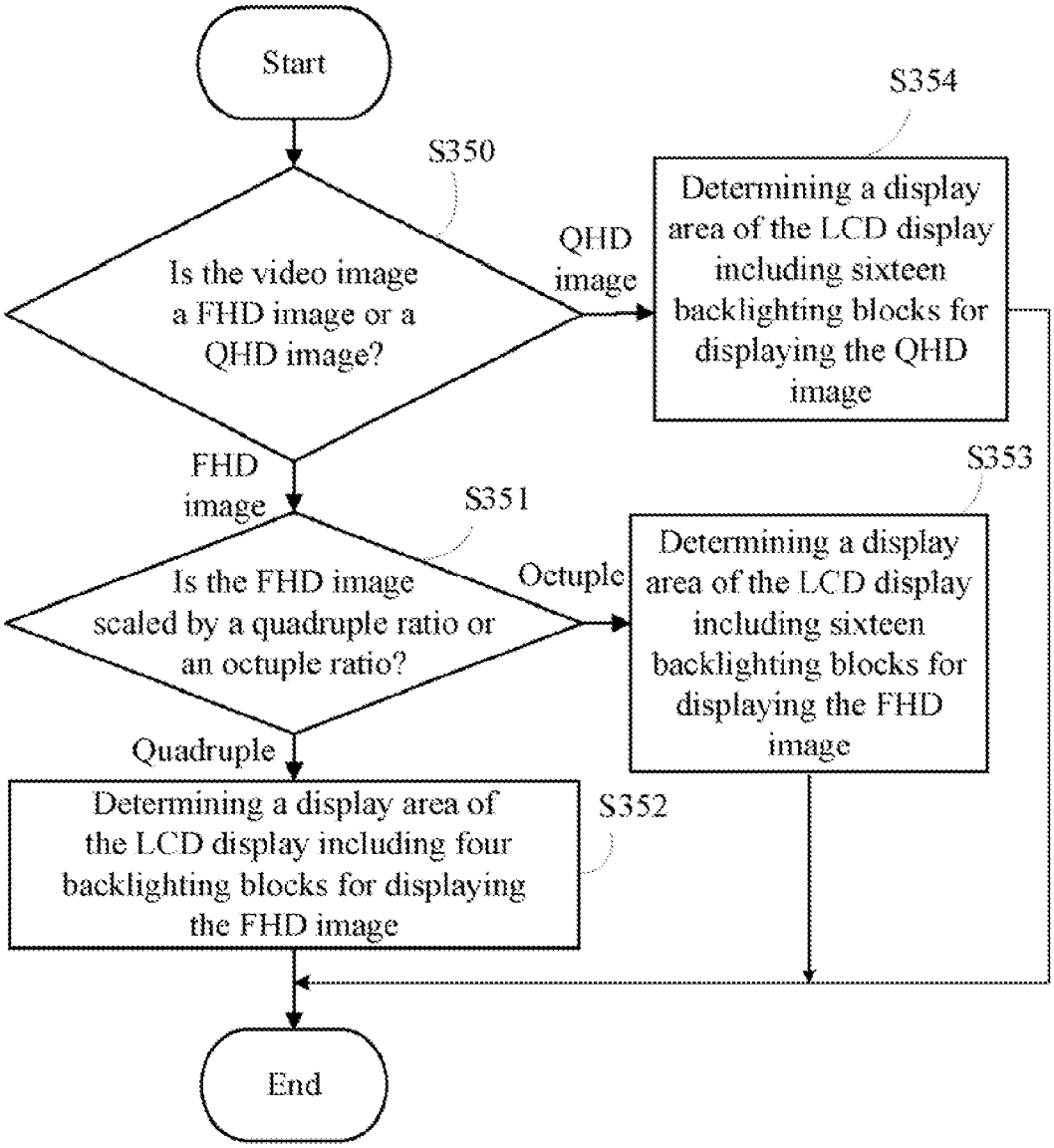
FIG. 5 is a detailed flowchart of step S35 in FIG. 3.

In step S35, the second confirmation module 105 determines a display area of the LCD display 11 for displaying the video image according to a scaled rate of the video image, and determines backlighting blocks of the backlight unit 110 corresponding to the determined display area, and then step S37 is implemented. A detailed description of step S35 is illustrated in FIG. 5.

Figure 6:
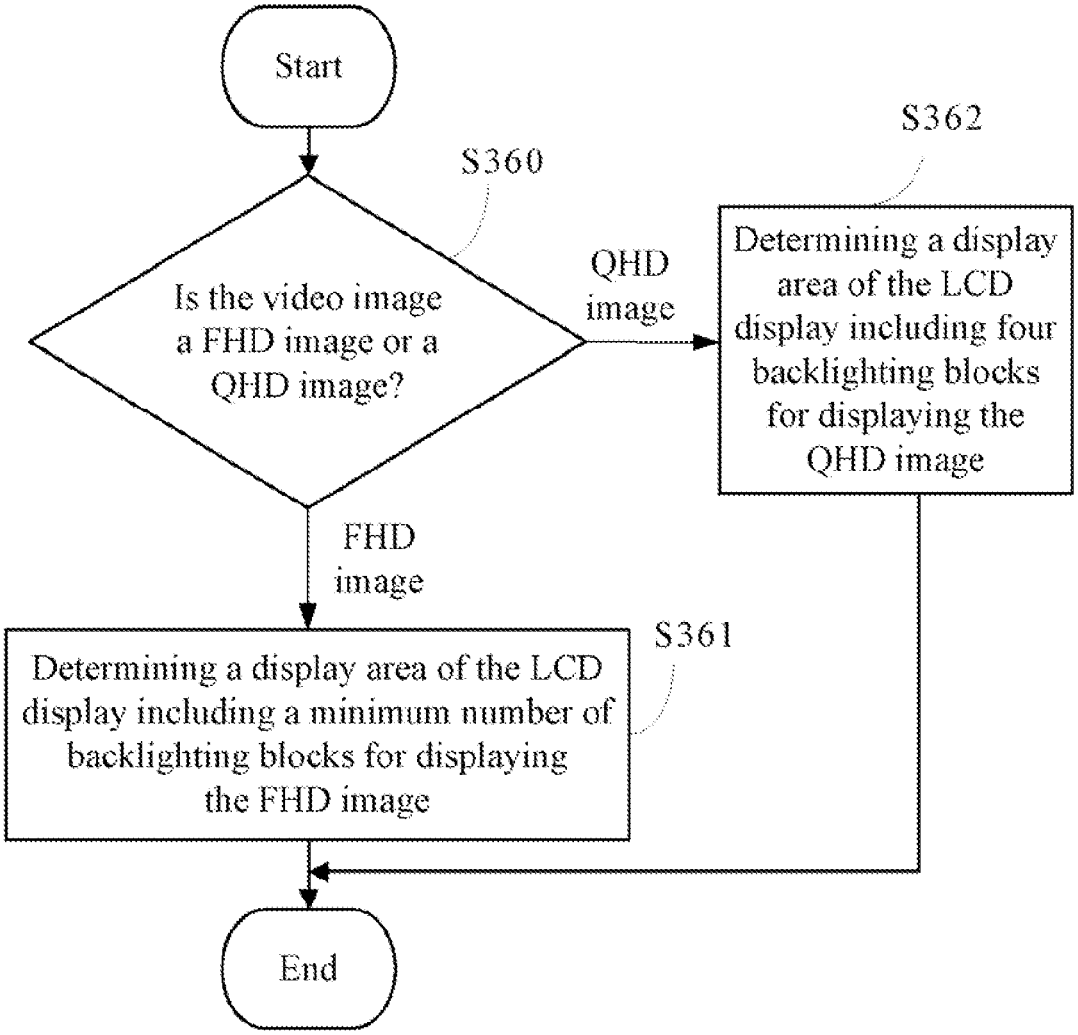
FIG. 6 is a detailed flowchart of step S36 in FIG. 3.

In step S36, the third confirmation module 106 determines a minimum display area of the LCD display 11 for displaying the video image, and determines backlighting blocks of the backlight unit 110 corresponding to the minimum display area, and then step S37 is implemented. A detailed description of step S36 is illustrated in FIG. 6.

In step S37, the control module 102 controls the backlighting blocks of the determined display area to provide backlighting for the LCD display 11, and then step S38 is implemented.

In step S38, the display module 107 displays the video image on the determined display area of the LCD display 11.

FIG. 4 is a detailed flowchart of step S33 in FIG. 3. Depending on the embodiment, additional steps can be added, other steps can be removed, and the ordering of the steps can be changed.

In step S330, the prompt module 103 determines whether the video image is a full high definition (FHD) image or a quadruple high definition (QHD) image. In the embodiment, the definition of FHD image is denoted as 1920×1080, and the definition of the QHD image is denoted as 2840×2160. If the video image is an FHD image, step S331 is implemented. If the video image is a QHD image, step S332 is implemented.

In step S331, the prompt module 103 determines sixteen display areas on the LCD display 11 for displaying the FHD image. In the embodiment, each of the sixteen display areas corresponds to a backlighting block of the backlight unit 110. The user can select one of the sixteen display areas to display the FHD image on the LCD display 11.

In step S332, the prompt module 103 determines four display areas on the LCD display 11 for displaying the QHD image. The user can select one of the four display areas to display the QHD image on the LCD display 11. In the embodiment, each of the four display areas corresponds to four backlighting blocks of the backlight unit 110. Referring to FIG. 7, if the LCD display 11 is divided into four display areas, represented by A1, A2, A3, and A4, the area A1 corresponds to backlighting blocks (1), (2), (5), and (6), the area A2 corresponds to backlighting blocks (9), (10), (13), and (14), the area A3 corresponds to backlighting blocks (3), (4), (7), and (8), and the area A4 corresponds to backlighting blocks (11), (12), (15), and (16).

FIG. 5 is a detailed flowchart of step S35 in FIG. 3. Depending on the embodiment, additional steps can be added, other steps can be removed, and the ordering of the steps can be changed.

In step S350, the second confirmation module 105 determines whether the video image is a full high definition (FHD) image or a quadruple high definition (QHD) image. If the video image is an FHD image, step S351 is implemented. If the video image is a QHD image, step S354 is implemented.

In step S351, the second confirmation module 105 determines whether the FHD image is scaled by a quadruple ratio (i.e., a ratio of 4:1) or an octuple ratio (i.e., a ratio of 16:1). If the FHD image is scaled by a quadruple ratio, step S352 is implemented. If the FHD image is scaled by an octuple ratio, step S353 is implemented.

In step S352, the second confirmation module 105 determines a display area of the LCD display 11 including four backlighting blocks for displaying the FHD image. In one example with respect to FIG. 8, if the display area B is determined as a display area to display the FHD image, the display area B corresponding to backlighting blocks (6), (7), (10), and (11) to provide a light source for the LCD display 11.

In step S353, the second confirmation module 105 determines a display area of the LCD display 11 including sixteen backlighting blocks for displaying the FHD image. That is, the FHD image is displayed on the LCD display 11 in full screen when the FHD image is scaled by the octuple ratio.

In step S354, the second confirmation module 105 determines a display area of the LCD display 11 including sixteen backlighting blocks for displaying the QHD image. That is, the video image is displayed on the LCD display 11 in full screen when the video image is the QHD image.

FIG. 6 is a detailed flowchart of step S36 in FIG. 3. Depending on the embodiment, additional steps can be added, other steps can be removed, and the ordering of the steps can be changed.

In step S360, the third confirmation module 106 determines whether the video image is a full high definition (FHD) image or a quadruple high definition (QHD) image. If the video image is the FHD image, step S361 is implemented. If the video image is the QHD image, step S362 is implemented.

Figure 8:
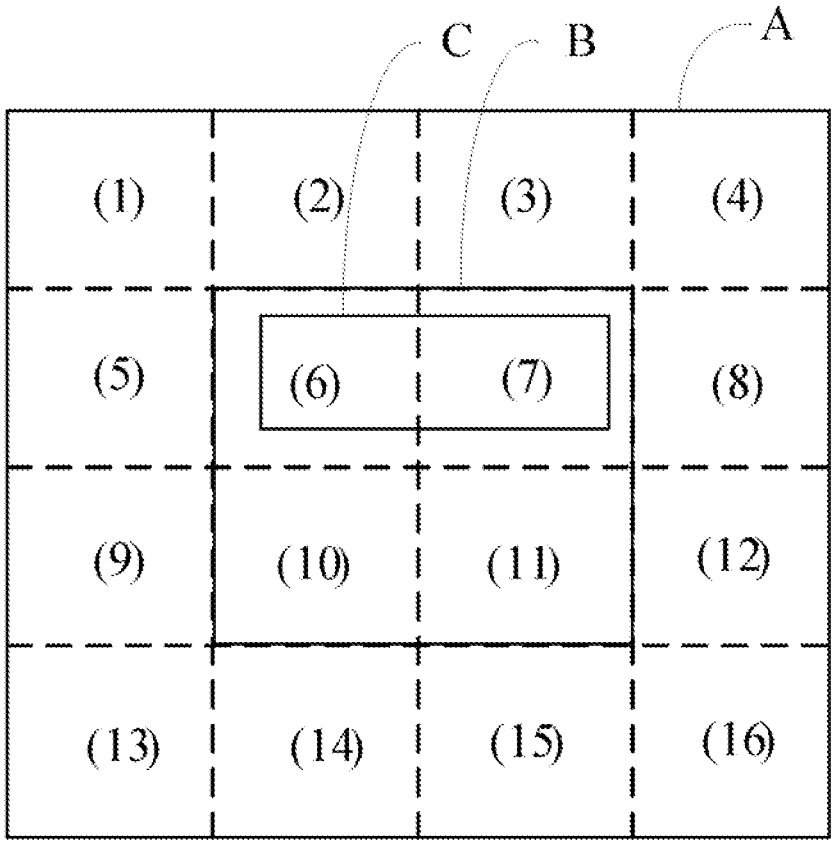
FIG. 8 is a schematic diagram illustrating one embodiment of display areas corresponding to each backlighting block in the backlight unit of the LCD display.

In step S361, the third confirmation module 106 determines a display area of the LCD display 11 including a minimum number of backlighting blocks for displaying the FHD image. As illustrated in FIG. 8, if the display area C is determined as a display area to display the FHD image, the display area C corresponds to backlighting blocks (6) and (7) to provide light source for the LCD display 11.

In step S362, the third confirmation module 106 determines a display area of the LCD display 11 including four backlighting blocks for displaying the QHD image. Referring to FIG. 8, if the display area B is determined for displaying the FHD image, the display area B corresponding to backlighting blocks (6), (7), (10) and (11) provides light source for the LCD display 11.

Although certain disclosed embodiments of the present disclosure have been specifically described, the present disclosure is not to be construed as being limited thereto. Various changes or modifications may be made to the present disclosure without departing from the scope and spirit of the present disclosure.

What is claimed is:

1. An electronic device, comprising:

a liquid crystal display (LCD) display comprising a backlight unit, the backlight unit comprising a plurality of backlighting blocks, each of the backlighting blocks comprising a plurality of light emitting diodes (LEDs) for providing light source to backlight the LCD display;

at least one processor; and a storage device storing a computer-readable program comprising instructions, which when executed by the at least one processor, that cause the at least one processor to:

determine whether a video image is an ultra high definition (UHD) image when the video image is received by the LCD display;

confirm that the video image is displayed on the LCD display in full screen if the video image is the UHD image, and initialize all backlighting blocks of the backlight unit to backlight the LCD display;

determine a display area of the LCD display for displaying the video image according to a definition of the video image if the video image is not the UHD image, and determine backlighting blocks of the backlight unit corresponding to the determined display area;

control the backlighting blocks of the determined display area to provide backlight for the LCD display; and display the video image on the determined display area of the LCD display.

2. The electronic device according to claim 1, wherein the computer-readable program further causes the at least one processor to:

determine whether the video image is to be displayed on a center area of the LCD display according to a position display parameter selected by a user;

determine whether the video image is scaled by the user if the video image is not the UHD image and the video image is to be displayed on the center area of the LCD display;

determine a display area of the LCD display for displaying the video image according to a scaled rate of the video image if the video image is scaled by the user, and determine backlighting blocks of the backlight unit corresponding to the determined display area; and determine a minimum display area of the LCD display for displaying the video image if the video image is not scaled by the user, and determine backlighting blocks of the backlight unit corresponding to the minimum display area.

3. The electronic device according to claim 2, wherein the computer-readable program further causes the at least one processor to:

determine sixteen display areas on the LCD display for displaying the video image if the video image is a full high definition (FHD) image, wherein each of the sixteen display areas corresponds to a backlighting block of the backlight unit; and determine four display areas on the LCD display for displaying the video image if the video image is a quadruple high definition (QHD) image, wherein each of the four display areas corresponds to four backlighting blocks of the backlight unit.

4. The electronic device according to claim 2, wherein the computer-readable program further causes the at least one processor to:

determine whether the video image is scaled by a quadruple ratio or an octuple ratio if the video image is a full high definition (FHD) image;

determine a display area of the LCD display including four backlighting blocks for displaying the FHD image if the FHD image is scaled by the quadruple ratio;

determine a display area of the LCD display including sixteen backlighting blocks for displaying the FHD image if the FHD image is scaled by the octuple ratio; and determine a display area of the LCD display including sixteen backlighting blocks for displaying the video image if the video image is a quadruple high definition (QHD) image.

5. The electronic device according to claim 2, wherein the computer-readable program further causes the at least one processor to:

determine a display area of the LCD display including a minimum number of backlighting blocks for displaying the video image if the video image is a full high definition (FHD) image; and determine a display area of the LCD display including four backlighting blocks for displaying the video image if the video image is a quadruple high definition (QHD) image.

6. The electronic device according to claim 1, wherein the LCD display is logically divided into a plurality of display areas, and each of the display areas corresponds to one or more backlighting blocks of the backlight unit.

7. A method for backlighting a liquid crystal display (LCD) display to provide different display definitions, the LCD display comprising a backlight unit, the backlight unit comprising a plurality of backlighting blocks, the method comprising steps of:

(a) determining whether a video image is an ultra high definition (UHD) image when the video image is received by the LCD display;

(b) confirming that the video image is displayed on the LCD display in full screen if the video image is the UHD image, and initializing all backlighting blocks of the backlight unit to backlight the LCD display, wherein each of the backlighting blocks comprises a plurality of light emitting diodes (LEDs) for providing a light source to backlight the LCD display;

(c) determining a display area of the LCD display for displaying the video image according to a definition of the video image if the video image is not the UHD image, and determining backlighting blocks of the backlight unit corresponding to the determined display area;

(d) controlling the backlighting blocks of the determined display area to provide backlight for the LCD display; and (e) displaying the video image on the determined display area of the LCD display.

8. The method according to claim 7, further comprising steps of:

(f) determining whether the video image is scaled by a user if the video image is not the UHD image and the video image is to be displayed on a center area of the LCD display;

(g) determining a display area of the LCD display for displaying the video image according to a scaled rate of the video image if the video image is scaled by the user, and determining backlighting blocks of the backlight unit corresponding to the determined display area; and (h) determining a minimum display area of the LCD display for displaying the video image if the video image is not scaled by the user, and determining backlighting blocks of the backlight unit corresponding to the minimum display area.

9. The method according to claim 8, wherein the step (b) comprises:

determining sixteen display areas on the LCD display for displaying the video image if the video image is a full high definition (FHD) image, wherein each of the sixteen display areas corresponds to a backlighting block of the backlight unit; and determining four display areas on the LCD display for displaying the video image if the video image is a quadruple high definition (QHD) image, wherein each of the four display areas corresponds to four backlighting blocks of the backlight unit.

10. The method according to claim 8, wherein the step (g) comprises:

determining whether the video image is scaled by a quadruple ratio or an octuple ratio if the video image is a full high definition (FHD) image;

determining a display area of the LCD display including four backlighting blocks for displaying the FHD image if the FHD image is scaled by the quadruple ratio;

determining a display area of the LCD display including sixteen backlighting blocks for displaying the FHD image if the FHD image is scaled by the octuple ratio; and determining a display area of the LCD display including sixteen backlighting blocks for displaying the video image if the video image is a quadruple high definition (QHD) image.

11. The method according to claim 8, wherein the step (h) comprises:

determining a display area of the LCD display including a minimum number of backlighting blocks for displaying the video image if the video image is a full high definition (FHD) image; and determining a display area of the LCD display including four backlighting blocks for displaying the video image if the video image is a quadruple high definition (QHD) image.

12. The method according to claim 7, wherein the LCD display is logically divided into a plurality of display areas, and each of the display areas corresponds to one or more backlighting blocks of the backlight unit.

13. A non-transitory storage medium having instructions, when executed by at least one processor of an electronic device, stored thereon that cause the processor to perform a method for backlighting a liquid crystal display (LCD) display to provide different display definitions, the LCD display comprising a backlight unit, the backlight unit comprising a plurality of backlighting blocks, the method comprising steps of:

(a) determining whether a video image is an ultra high definition (UHD) image when the video image is received by the LCD display;

(b) confirming that the video image is displayed on the LCD display in full screen if the video image is the UHD image, and initializing all backlighting blocks of the backlight unit to backlight the LCD display, wherein each of the backlighting blocks comprises a plurality of light emitting diodes (LEDs) for providing light source to backlight the LCD display;

(c) determining a display area of the LCD display for displaying the video image according to a definition of the video image if the video image is not the UHD image, and determining backlighting blocks of the backlight unit corresponding to the determined display area;

(d) controlling the backlighting blocks of the determined display area to provide backlight for the LCD display; and (e) displaying the video image on the determined display area of the LCD display.

14. The non-transitory storage medium according to claim 13, wherein the method further comprises steps of:

(f) determining whether the video image is scaled by a user if the video image is not the UHD image and the video image is to be displayed on a center area of the LCD display;

(g) determining a display area of the LCD display for displaying the video image according to a scaled rate of the video image if the video image is scaled by the user, and determining backlighting blocks of the backlight unit corresponding to the determined display area; and (h) determining a minimum display area of the LCD display for displaying the video image if the video image is not scaled by the user, and determining backlighting blocks of the backlight unit corresponding to the minimum display area.

15. The non-transitory storage medium according to claim 14, wherein the (b) step comprises:

determining sixteen display areas on the LCD display for displaying the video image if the video image is a full high definition (FHD) image, wherein each of the sixteen display areas corresponds to a backlighting block of the backlight unit; and determining four display areas on the LCD display for displaying the video image if the video image is a quadruple high definition (QHD) image, wherein each of the four display areas corresponds to four backlighting blocks of the backlight unit.

16. The non-transitory storage medium according to claim 14, wherein the step (g) comprises:

determining whether the video image is scaled by a quadruple ratio or an octuple ratio if the video image is a full high definition (FHD) image;

determining a display area of the LCD display including four backlighting blocks for displaying the FHD image if the FHD image is scaled by the quadruple ratio;

determining a display area of the LCD display including sixteen backlighting blocks for displaying the FHD image if the FHD image is scaled by the octuple ratio; and determining a display area of the LCD display including sixteen backlighting blocks for displaying the video image if the video image is a quadruple high definition (QHD) image.

17. The non-transitory storage medium according to claim 14, wherein the step (h) comprises:

determining a display area of the LCD display including a minimum number of backlighting blocks for displaying the video image if the video image is a full high definition (FHD) image; and determining a display area of the LCD display including four backlighting blocks for displaying the video image if the video image is a quadruple high definition (QHD) image.

18. The non-transitory storage medium according to claim 13, wherein the LCD display is logically divided into a plurality of display areas, and each of the display areas corresponds to one or more backlighting blocks of the backlight unit.

* * * * *